US011278061B2

(12) United States Patent
Stockton

(10) Patent No.: US 11,278,061 B2
(45) Date of Patent: Mar. 22, 2022

(54) LEAK RESISTANT DIAPER COVER AND METHOD(S) OF USE THEREOF

(71) Applicant: Nancy Stockton, Englewood, CO (US)

(72) Inventor: Nancy Stockton, Englewood, CO (US)

( * ) Notice: Subject to any disclaimer, the term of this patent is extended or adjusted under 35 U.S.C. 154(b) by 0 days.

(21) Appl. No.: 16/606,298

(22) PCT Filed: Jul. 25, 2019

(86) PCT No.: PCT/US2019/043384
§ 371 (c)(1),
(2) Date: Oct. 18, 2019

(87) PCT Pub. No.: WO2020/033157
PCT Pub. Date: Feb. 13, 2020

(65) Prior Publication Data

US 2022/0022558 A1 Jan. 27, 2022

Related U.S. Application Data

(60) Provisional application No. 62/717,391, filed on Aug. 10, 2018.

(51) Int. Cl.
*A41B 13/04* (2006.01)
*A41D 31/10* (2019.01)
*A41D 7/00* (2006.01)

(52) U.S. Cl.
CPC ..... *A41B 13/04* (2013.01); *A41D 7/005* (2013.01); *A41D 31/10* (2019.02)

(58) Field of Classification Search
CPC ..... A41B 13/04; A41D 7/005; A41D 31/10
See application file for complete search history.

(56) References Cited

U.S. PATENT DOCUMENTS

| | | | | |
|---|---|---|---|---|
| 1,491,690 | A | 4/1924 | George | |
| 1,695,109 | A | 12/1928 | Kosloff | |
| 2,921,583 | A | 1/1960 | Lerner | |
| 3,513,847 | A | 5/1970 | Artzt | |
| 5,628,064 | A * | 5/1997 | Chung | A41D 15/00 2/119 |
| 7,305,717 | B1 * | 12/2007 | Brown | A41D 13/1272 2/114 |
| 9,475,264 | B2 | 10/2016 | Melander | |
| 2005/0032668 | A1 * | 2/2005 | Pedersen | A01N 37/02 510/499 |
| 2006/0191054 | A1 * | 8/2006 | Noe | A62B 17/006 2/79 |
| 2007/0266472 | A1 * | 11/2007 | DuFaux | A41D 15/002 2/80 |
| 2010/0125926 | A1 | 5/2010 | Simonetti | |

(Continued)

FOREIGN PATENT DOCUMENTS

WO WO9918904 4/1999

*Primary Examiner* — Khaled Annis
(74) *Attorney, Agent, or Firm* — Leyendecker & Lemire LLC

(57) ABSTRACT

A leak resistant diaper cover and method of use thereof is described. Embodiments of the leak resistant diaper cover can be manufactured into a unitary piece of silicone that includes a tapered waist and tapered legs. The leak resistant diaper cover can be adapted to be worn over a diaper (or other undergarment) to help ensure that water does not enter into the diaper cover and that nothing exits the diaper cover.

11 Claims, 6 Drawing Sheets

(56) References Cited

U.S. PATENT DOCUMENTS

| | | | | |
|---|---|---|---|---|
| 2011/0131699 | A1* | 6/2011 | Hannon | A41B 13/04 2/80 |
| 2012/0010582 | A1 | 1/2012 | Newnam | |
| 2012/0180188 | A1 | 7/2012 | Banica | |
| 2013/0125287 | A1* | 5/2013 | Boyle | A41D 15/002 2/70 |
| 2015/0071978 | A1 | 3/2015 | Chang | |
| 2017/0265531 | A1* | 9/2017 | Toussaint | A41D 7/005 |

* cited by examiner

LEAK RESISTANT DIAPER COVER AND METHOD(S) OF USE THEREOF

CROSS-REFERENCE TO RELATED APPLICATION

This application claims the benefit of U.S. Provisional Application No. 62/717,391, filed on Aug. 10, 2018.

BACKGROUND

One significant problem associated with allowing infants and toddlers to swim in recreational water venues (e.g., private pools, public pools, water parks, etc.) is the risk that they may urinate or defecate while in the water causing contamination of the recreational water and an increased potential for recreational water illnesses (RWIs). Typically, when this happens the pool is often closed for a period of time to allow all the water within the pool to be cycled through the pool's filtration system and often the chlorine levels in the water are raised.

Health issues or cultural norms may cause older children and adults to urinate or defecate while in recreational water. The following statements are quoted from the article, *Healthy Swimming, Fecal Accident Response Recommendations for Pool Staff*, written by The Centers for Disease Controls and Prevention and can be found at http://www-.floridahealth.gov/environmental-health/swimming-pools/_documents/fecal_accident_response_reco.pdf. "RWIs are spread by swallowing pool water that has been contaminated with fecal matter." "RWIs are caused by germs such as 'Crypto, short for Cryptosporidium, Giardia, *E. coli* 0157: H7 and Sigelia.'" "Germs causing RWIs are killed by chlorine. However, chlorine doesn't work right away. It takes time to kill germs and some germs like Crypto can live in pools for days. Even the best maintained pools can spread illness." (See article cited above).

Solutions have been offered in the form of swim diapers that partially mitigate the intrusion of solid waste into the recreational water by containing them, but no adequate solution has been proposed to prevent the exchange of liquids, with diarrhea being a higher risk event. Recreational water intrusion into currently offered solutions water logs them, preventing absorption and containment of urine and other liquid waste. Further, there is no protection of delicate areas from potential contaminations already in the recreational water.

Urine is made up of many different substances, all of which can interact with chlorine. Uric acid, chloramine, and a handful of amino acids pose the biggest threat. While chlorine is helpful in killing germs and preventing recreational water illnesses (RWIs), when more chlorine is added the likelihood of chemical reactions that create those harmful compounds increases. Excessive urine in recreational water causes eye irritation and aggravates respiratory issues.

An article from the Centers for Disease Control and Prevention that can be found at https://www.cdc.gov/healthywater/swimming/swimmers/swim-diapers-swim-pants.html states, "Swim diapers can delay diarrhea-causing germs, like Cryptosporidium, from leaking into the water for a few minutes, but swim diapers do not keep these germs from contaminating the water. No manufacturers claim these products prevent leakage of diarrhea into pools."

DETAILED DESCRIPTION

Figure 1:
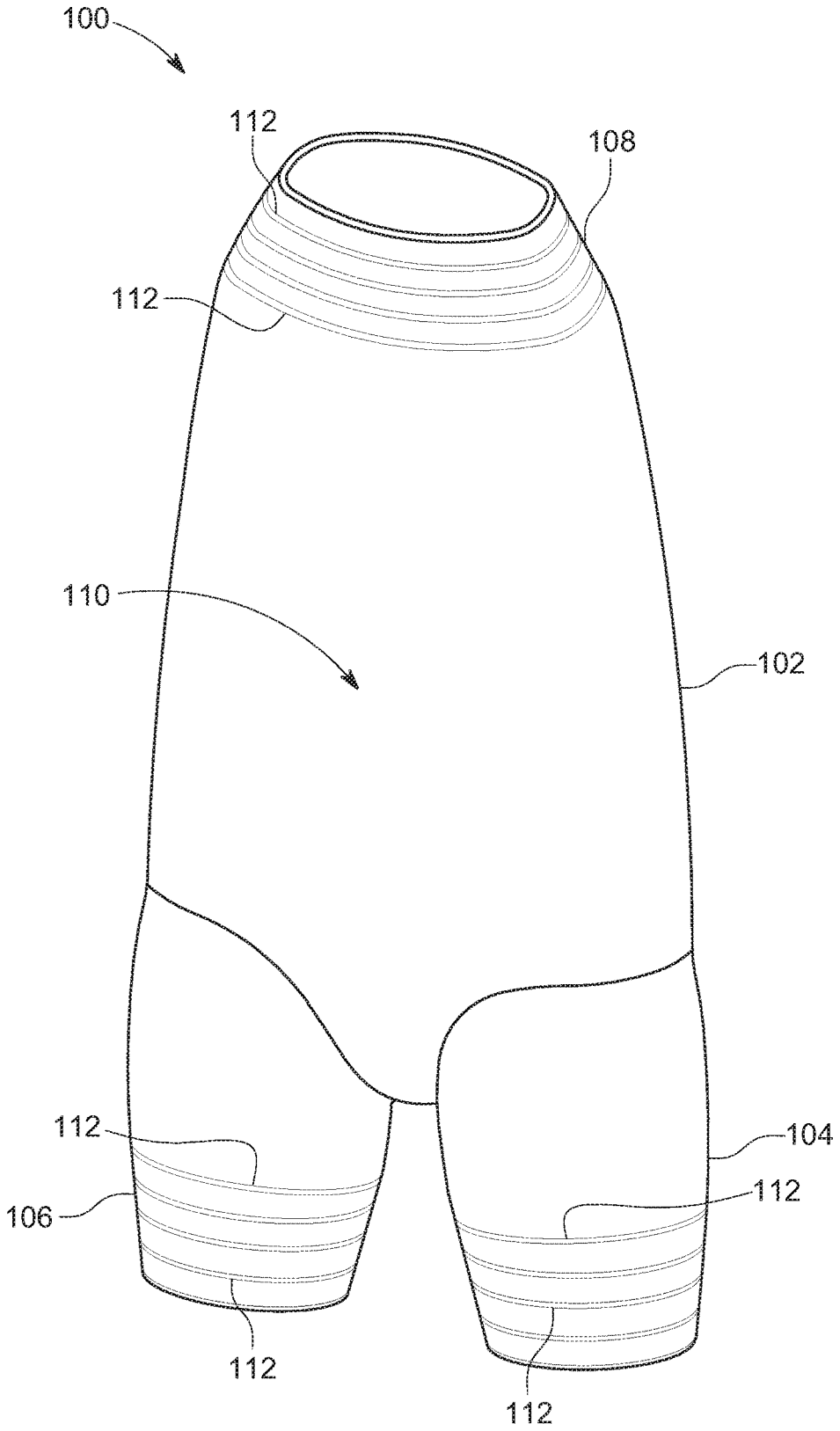
FIG. 1 is a front perspective view of a leak resistant diaper cover according to one embodiment of the present invention.

Embodiments of the present invention include a leak resistant diaper cover. In one embodiment, the leak resistant diaper cover can be implemented as swimwear for an infant, toddler, child, teenager, or adult. In another embodiment, the leak resistant diaper cover can be implemented as an undergarment cover for children and adults. In yet another embodiment, the leak resistant diaper cover can be implemented as a leak resistant undergarment for children and adults. The terms "diaper cover," "swimwear," and "undergarment cover," can be used interchangeably throughout the specification and embodiments of the present invention can be implemented for each use. Typically, the leak resistant swimwear can be manufactured from an elastomeric material into a unitary body. A substantially leak-proof seal can be formed between the swimwear and a wearer when the leak resistant swimwear is being worn. Hereinafter, the leak resistant diaper cover will be referred to as "swimwear".

In one embodiment, the leak resistant swimwear can comprise swimwear (or trunks) molded as a single (or unitary) piece of elastomeric material. The swimwear may include no seams or other joints that could or would be sources of potential leaks. In one instance, leg openings and a waist opening can be tapered and configured to be smaller in circumference than respective legs or torso of an intended wearer such that the leg openings and the waist opening expand when worn and conform to the wearer to form a substantially water tight seal.

As previously mentioned, the swimwear can be molded as a single piece of material from an elastomeric material. Any suitable material can be used, but one having a high degree of elastic elongation and relatively high tear strength is preferred. Certain formulations of polyurethane or silicone can be employed in certain embodiments. The elastomeric material may be dyed to any desired color, typically prior to the polymerization of the elastomeric synthetic resin in and/or on the mold on which the swimwear is formed. The legs and waist of the swimwear can be tapered and designed to be form fitting on a wearer; whereas, the lower torso region can be intended to be a looser fit to accommodate a diaper or other underwear.

In one embodiment, the leak resistant swimwear can include concentric parallel lines on each of the legs and the waist of the swimwear. These lines can be molded into the swimwear and/or printed on the swimwear after formation by any suitable process. Additional information may also be printed proximate the lines such as a circumference of each of the lines. Of note, because of the tapered configuration of the legs and waist region, the circumference of each successive line progressing inwardly from the respective openings are larger than the proceeding one. In one use, the lines serve as guides for sizing the swimwear to a particular wearer. Ideally, the leg and waist openings fit snuggly, but not too tightly, around a waist and legs of a wearer to provide a substantially watertight seal but not hinder blood circulation of the wearer.

In an initial fitting of the swimwear, a caregiver may put the swimwear on a child and note the relative tightness of the various openings. If too tight, the caregiver may trim the swimwear along selected lines to create larger openings as desired. The swimwear can then be tried on again to verify the appropriate level of snugness. If the swimwear is still too tight proximate the openings, the swimwear can be trimmed again along one the remaining lines. It is to be appreciated that the ability to trim the openings and make them larger can also be used as necessary, as a child grows, without the need to buy a new leak resistant swimwear. Another method of fitting the swimwear includes measuring the circumference of a child's leg and/or waist and trimming the swimwear along the appropriate line(s) for the particular measured circumferences.

Due to the elastic nature of the elastomeric material, along with a snugness of the fit around the legs and the waist, liquid is not easily capable of entering or exiting an interior of the leak resistant swimwear. Accordingly, water from a recreational water venue will not water log the absorbent material of a diaper permitting the diaper to perform properly and absorb any effluent. The sealed legs and waist prevent any effluent or solid waste from being discharged into recreational water creating an unsanitary condition and prevent any contaminated water from entering delicate areas.

In one example manufacturing method, a mold can be implemented to fabricate the leak resistant swimwear. The mold can be larger in a lower torso region to make the resulting swimwear larger in this region to accommodate diapers. The molds would have a substantially smooth surface that can be treated with appropriate release agents. Further, the mold may have surface features inscribed thereon that would facilitate the formation of the circumferential lines on the legs and the waist of the swimwear.

To make a pair of leak resistant swimwear using this type of mold, a liquid synthetic resin can either be sprayed onto the mold or the mold can be dipped in a bath of synthetic resin and removed therefrom. The synthetic resin resident on a surface of the mold can then be cured typically through the application of heat. As necessary, the excess cured synthetic resin can be cut from the desired swimwear portion and the swimwear can be removed from the mold.

In another example manufacturing method, a female clamshell mold can be implemented. Synthetic resin can be poured into a cavity of the female clamshell mold and the cavity can be rotated several times about multiple axes to coat an interior of the mold. After the interior of the mold may be coated, the synthetic resin can be cured. The mold can then be separated and the swimwear can be removed. As necessary, the swimwear can be trimmed to remove any excess material.

In yet another example manufacturing method, an injection mold and injection molding machine can be implemented. As can be appreciated, melted or uncured elastomeric material is injected into the mold.

As previously mentioned, the swimwear can be used by an infant, toddler, child, or adult while swimming or wading in a pool or other communal body of water. The swimwear can be implemented such that defecation or urination by a wearer will not result in liquid or solid waste being introduced into the body of water. Further, because the underlying diaper will not become water logged, the diaper may absorb any liquid waste. While the swimwear is intended for use with diapers, the swimwear can also be used with children or adults who are prone to accidents, especially when in water. The swimwear can be made in larger sizes for adults who may be prone to accidents, want to make a social statement that they are not peeing in the pool, or want to protect themselves from potential contaminants in the pool.

One embodiment of the present invention can include a substantially leak resistant swimwear comprised of a single piece of molded elastomeric material having only openings for a pair of legs and a waist. The legs and the waist of the swimwear may be tapered. Indicia comprising a series of parallel circumferential lines can be provided on each leg and the waist. The circumferential lines can be molded into the swimwear. In another instance, the circumferential lines can be printed on the swimwear. The swimwear may include additional indicia (e.g., a measurement for each circumferential line) on the swimwear pertaining to the circumferential lines. The elastomeric material can comprise a polyurethane or silicone. The swimwear can include an increased thickness of material near the waist and each of the legs.

A method of using the previously described swimwear can include one or more of the following steps. Generally, in a first step, the swimwear can be sized to a wearer. To size the swimwear, a parent may measure a circumference of at least one thigh of the wearer and the waist of the wearer. The parent may then determine which circumferential line on the legs and waist of the swimwear correspond to the circumference of the thigh and waist of the wearer. If the thighs or waist are larger than the smallest circumferential line, the parent may cut excess material off below the matching circumferential line. As can be appreciated, since the legs and waist are tapered, by removed material from a bottom of the legs (or top of the waist) the openings for each can be made larger. After the swimwear is appropriately sized to the wearer, the parent may put the swimwear on the wearer. The parent may then make sure that blood flow is not restricted while the wearer has the swimwear on. As previously mentioned, the swimwear can be designed to be worn by those who still wear diapers or have problems controlling their bladder or bowels. As such, the swimwear can be put on an infant, toddler, child, or adult over a diaper (or other undergarments) such that the openings in the legs and the waist form a substantially water tight seal against the legs and the waist of the wearer. After the wearer has the swimwear on, the wearer may enter a body of water so that the swimwear can be partially or fully submerged.

Embodiments of the swimwear can be a substantially leakproof cover for regular diapers or underwear. The main purpose of the swimwear can be to allow a child or adult to swim without liquids or solids leaking out of the swimwear, and prevent recreational water from leaking into the swimwear. In addition to swimming activities, the swimwear can provide a level of assurance against baby "blowouts" or diaper leaks in everyday situations or for special occasions. The swimwear may also be used in cloth diapering applications.

The unique leakproof qualities of the swimwear can be accomplished by molding a single piece of elastomeric material. Of note, the waist of the swimwear can be higher than traditional diaper covers and the legs are longer and cover all or part of the thigh. Slight tension at the legs and waist openings help create a substantially leakproof seal between the swimwear and a wearer. Of significant note, there are no seams, sewing, zippers, fasteners, additional elastic gatherings, etc. included with the swimwear. As previously mentioned, there is no cloth or other material as the entire pair of swimwear can be formed into a single piece of material. Using a single molded piece of elastomer prevents bits of thread, cotton, hemp, bamboo, and other microfibers from detaching, as happens with traditional swim diapers. These bits, especially those from currently available disposable swim diapers can cause clogs in a filtration system of a swimming pool.

As previously mentioned, the swimwear can be adjustable in size. In one instance, this is accomplished by molding tapered leg and waist openings. As the child grows, the parent can trim the tapered legs and waist causing the openings to be bigger. The trim-ability allows the parent to set the tension around the legs and waist to assure blood circulation is appropriately maintained, while still providing a leakproof seal. Embodiments of the swimwear include indicators molded into the leg and waist openings which correspond to measurements of leg and waist circumferences. Even with the adjustability, the swimwear can be offered in multiple sizes. For instance, newborn, infant, baby, toddler, child, and adult sizes are contemplated. The main body of the swimwear can allow ample space for the addition of fluids and growth.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

An Embodiment of a Leak Resistant Swimwear

Referring to FIG. 1, a detailed diagram of an embodiment 100 of a leak resistant swimwear is illustrated. The leak resistant swimwear 100 can typically be implemented with infants and toddlers (referred to as "toddlers" from hereon) still wearing diapers. The swimwear 100 can allow for a toddler to wear normal diapers when swimming instead of having to change into a swim diaper that does not protect against the leakage of urine from the diaper into a body of water.

Typically, a body 102 of the swimwear 100 can be manufactured into (or from) a unitary piece of material. In one example, the body 102 of the swimwear 100 can have a thickness of approximately 1.5 mm-2.0 mm. An elastomeric material can be implemented to comprise the body 102 of the swimwear 100. In one embodiment, the elastomeric material can be silicone. Typically, a hypoallergenic grade silicone can be implemented to minimize any irritation from contact with skin. In another embodiment, the elastomeric material can be a polyurethane. Of note, other elastomeric polymers are contemplated for use in making the swimwear 100. In some instances, the elastomeric material may also include fillers and/or additives to improve physical and mechanical properties of the elastomeric material. For example, in some variations, the synthetic resin can include a fumed silica additive to impart improved tear resistance.

As shown, the body 102 can include a first leg 104, a second leg 106, a waist 108, and a middle section 110. The legs 104, 106 and the waist 108 can each include a plurality of circumferential lines (or markings) 112. In some instances, the legs 104, 106 and the waist 108 can be thicker than the middle section 110 of the body 102. Of note, a parent can typically grab and pull the swimwear 100 approximate the legs 104, 106 and the waist 108. Since parents will be tugging on the legs 104, 106 and the waist 108, the swimwear 100 can be reinforced at those sections by increasing a thickness of material at those sections. In such embodiments where the thickness of the legs 104, 106 and the waist 108 is greater than the middle section 110 of the body, the legs 104, 106 and the waist 108 can have a thickness of approximately 2.0 mm-3.0 mm.

The circumferential lines 112 can be implemented to denote a particular circumference of said portion on the swimwear 100. As can be appreciated, a wearer may match a circumference of a thigh or waist of the wearer with a circumferential line. The wearer may then remove any excess material past the matched circumferential line such that when being worn, the swimwear 100 provides a leak resistant fit while still allowing for proper blood flow.

The legs 104, 106 can each be tapered down towards an opening of the legs. By tapering the legs 104, 106, material can be cut removed to create a larger opening in the legs 104, 106. For instance, a child with thinner thighs may not need to remove any material whereas a child with thicker thighs may need to remove material so that the swimwear 100 fits properly.

In one embodiment, the leak resistant swimwear 100 can comprise swimwear (or shorts) molded as a single (or unitary) piece of elastomeric material. The swimwear 100 may include no seams or other joints that could or would be sources of potential leaks. In one instance, the legs 104, 106 and the waist 108 can be tapered and configured to be smaller in circumference than respective legs or torso of an intended wearer such that the legs and the waist expand when worn and conform to the wearer to form a substantially water tight seal.

In one example embodiment, the elastomeric material can be a hypoallergenic grade silicone having one of the following sets of properties listed in TABLE 1:

TABLE 1

| Property/Item | Silicone Material 1 | Silicone Material 2 |
|---|---|---|
| Elongation at break | 980% | 750% |
| 100% Modulus | 12 psi | N/A |
| Tensile strength | 2.17 MPa/315 psi | 7.0 MPa/1015 psi |
| Density | 1.07 | 1.06-1.10 |

Figure 2A:
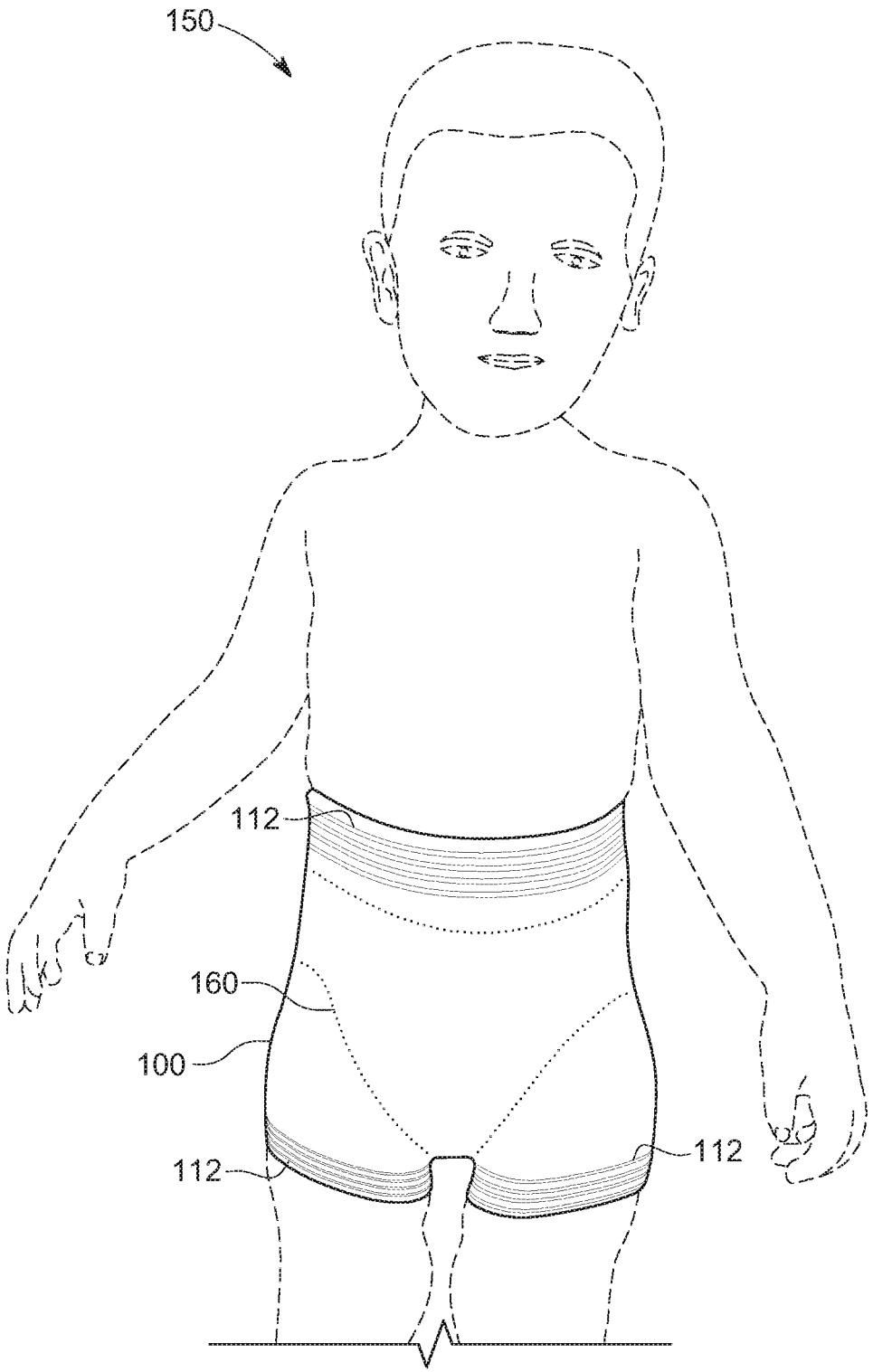
FIG. 2A is a front view of a leak resistant diaper cover on a toddler according to one embodiment of the present invention.
Figure 2B:
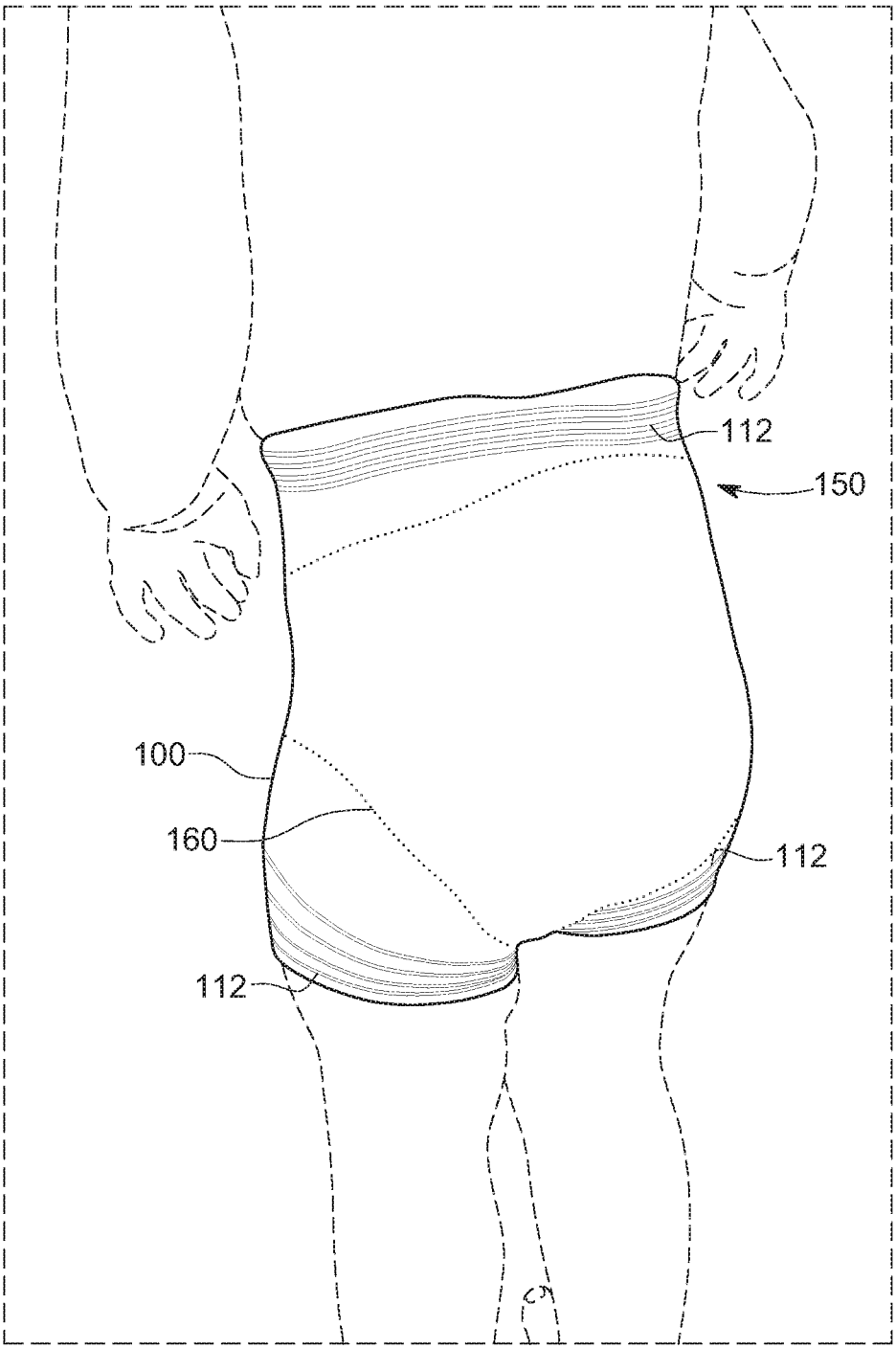
FIG. 2B is a back view of a leak resistant diaper cover on a toddler according to one embodiment of the present invention.

Referring to FIGS. 2A-2B, the leak resistant swimwear 100 is illustrated being worn by a toddler 150. Of note, the toddler 150 is wearing a diaper 160 under the swimwear 100. Of significant note, the swimwear 100 can be worn by the toddler 150 while the toddler is wearing a normal diaper 160. Since the swimwear 100 creates a leak resistant fit on the toddler 150, any fluids or solids in the diaper 160 will not leak into a body of water. The leak resistant swimwear 150 can be implemented to ensure that a child wearing a diaper can enter into a body of water without having any urine or fecal matter released into the body of water.

Figure 3A:
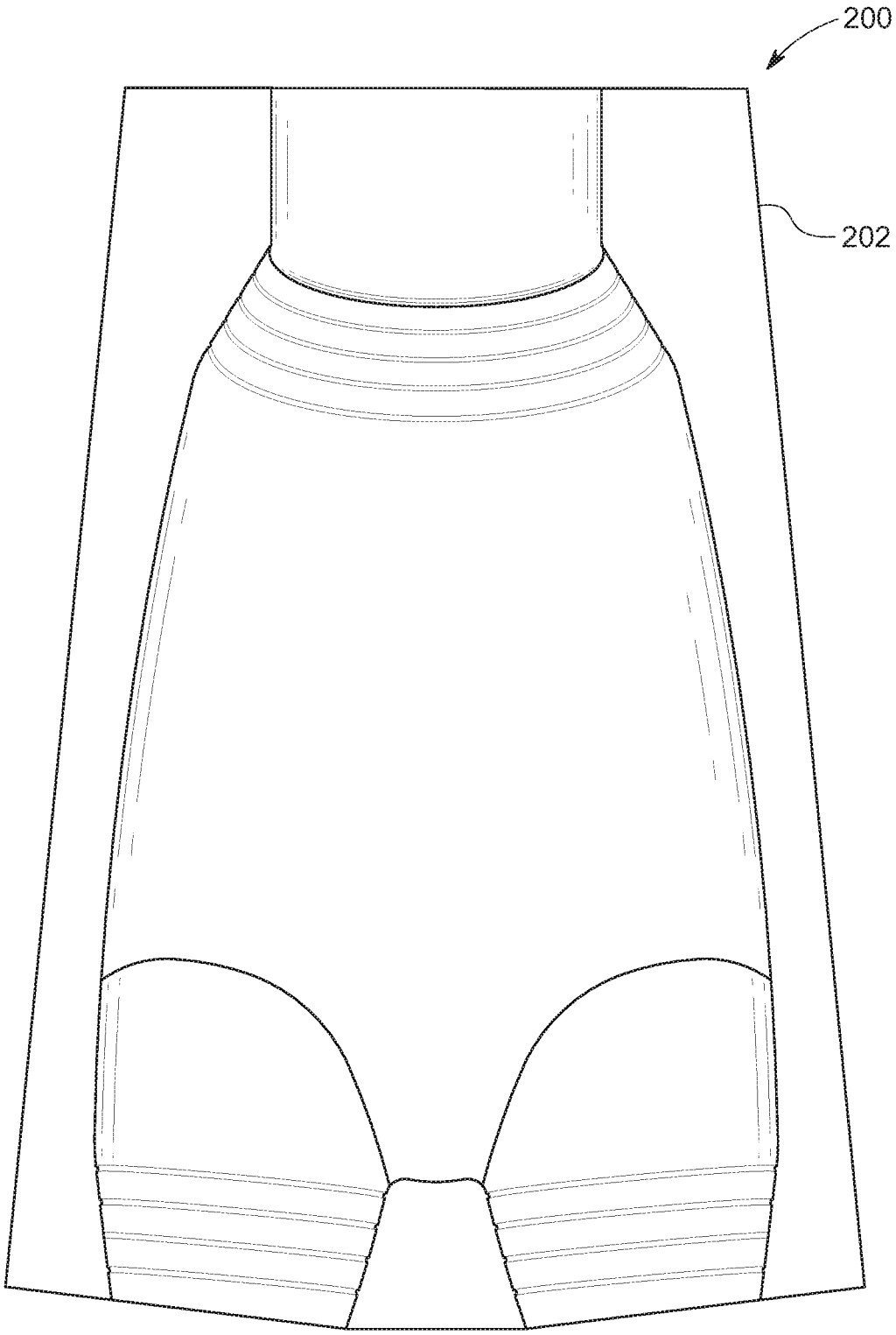
FIG. 3A is a top view of one half of a mold for making a leak resistant diaper cover according to one embodiment of the present invention.
Figure 3B:
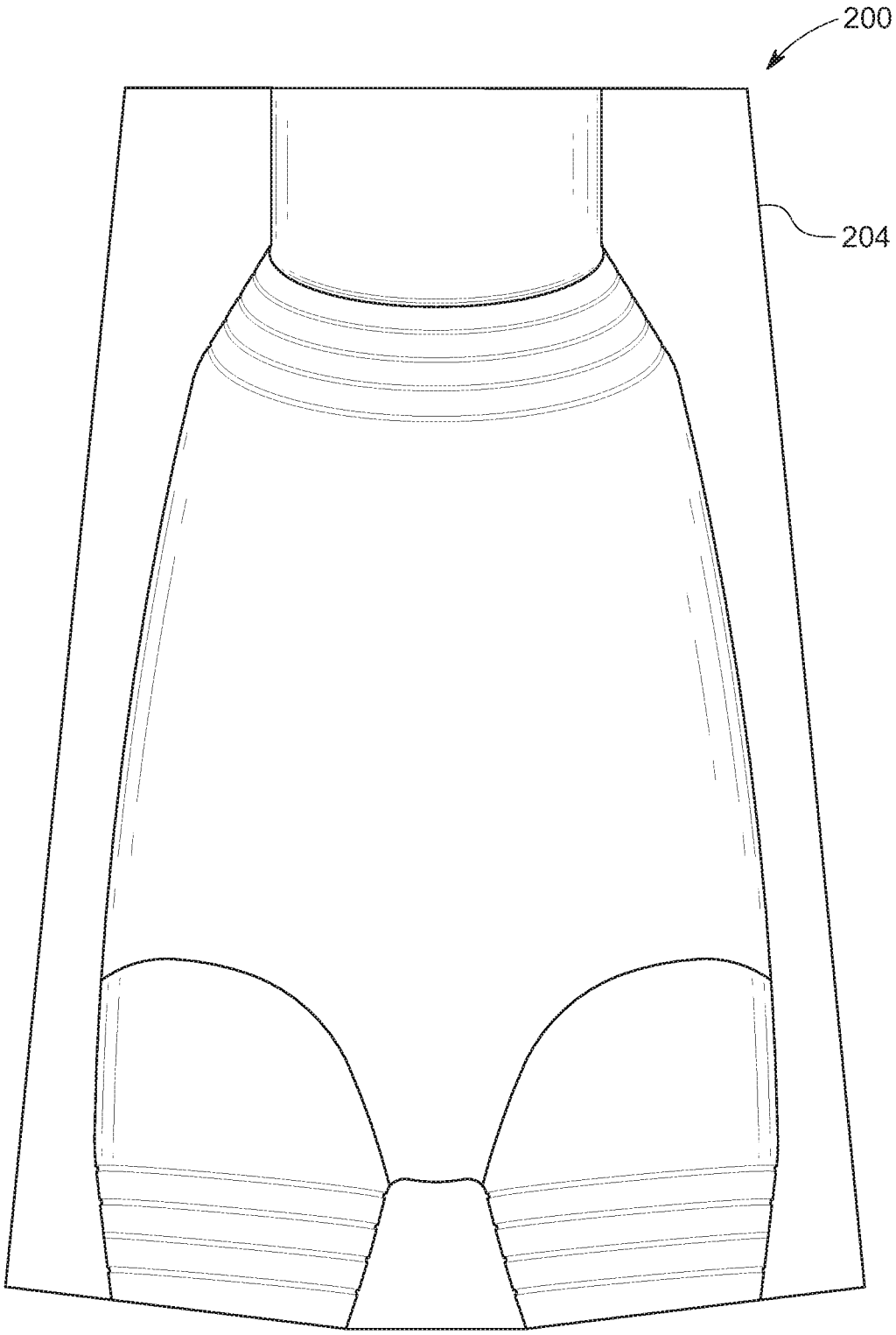
FIG. 3B is a top view of another half of a mold for making a leak resistant diaper cover according to one embodiment of the present invention.
Figure 3C:
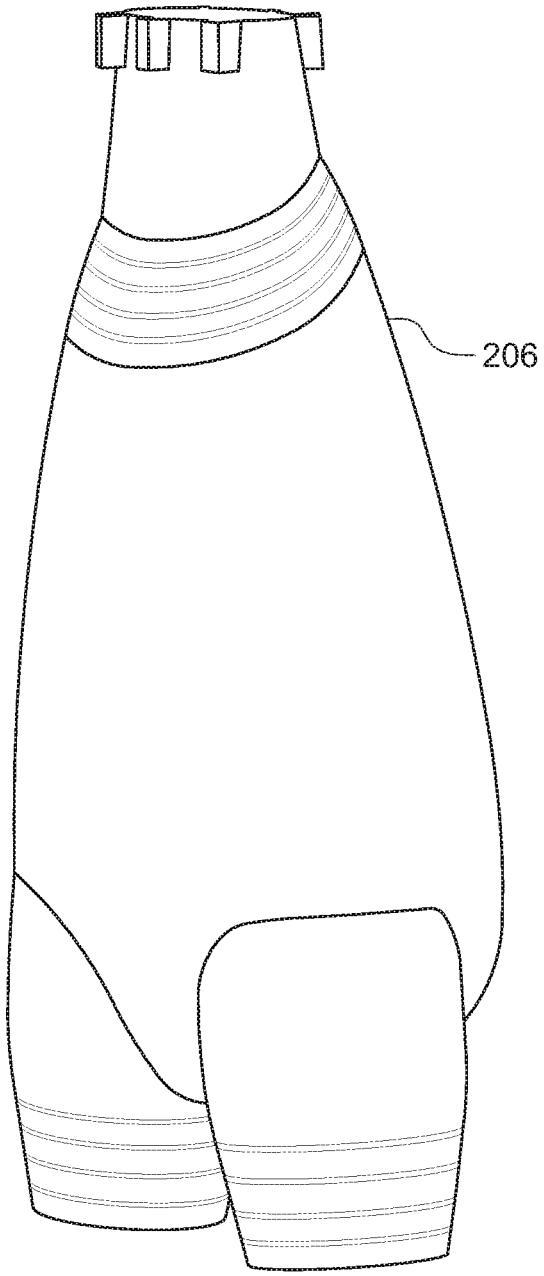
FIG. 3C is front view of a male member of a mold for making a leak resistant diaper cover according to one embodiment of the present invention.

Referring to FIGS. 3A-3C, one embodiment 200 of a mold for manufacturing the previously described leak resistant swimwear 100 is illustrated. The mold 200 can be implemented to make one example of the swimwear 100. In one instance, the mold 200 can be a clamshell mold that can be implemented in a rotational molding process. In another instance, the mold 200 can be implemented in a spray molding process.

Referring to FIG. 3A, a top view of a first half 202 of the mold 200 is illustrated. Referring to FIG. 3B, a top view of a second half 204 of the mold 200 is illustrated. Referring to FIG. 3C, a perspective view of a male member 206 of the mold 200 is shown.

Generally, the molds 202, 204 can have have a substantially smooth surface that can be treated with appropriate release agents. As shown in FIGS. 3A-3B, the molds 202, 204 can include surface features inscribed thereon that would facilitate the formation of the circumferential lines 112 on the legs 104, 106 and the waist 108 of the swimwear 100.

In one example manufacturing method to make the leak resistant swimwear 100, the male member 206 can be sandwiched between the two half molds 202, 204 of the mold 200. A synthetic resin can be poured into the mold 200 and then the synthetic resin can be cured. Alternatively, the two half molds 202, 204 can be coated with synthetic resin and then the male member 206 can be sandwiched between the coated half molds 202, 204. After the synthetic resin cures, any excess cured synthetic resin can be removed from the swimwear 100.

In another example manufacturing method to make the leak resistant swimwear 100 using the mold 200, a liquid synthetic resin can either be sprayed onto the molds 202, 204 or the molds 202, 204 can be dipped in a bath of synthetic resin and removed therefrom. The synthetic resin resident on a surface of the mold 200 can then be cured typically through the application of heat. As necessary, excess cured synthetic resin can be cut from the desired swimwear portion and the swimwear 100 can be removed from the mold 200.

In yet another example manufacturing method, synthetic resin can be poured into a cavity formed between the molds 202, 204 and the cavity can be rotated several times about multiple axes to coat an interior of the mold 200. After the interior of the mold 200 may be coated, the synthetic resin can be cured. The mold 200 can then be separated and the swimwear 100 can be removed. As necessary, the swimwear 100 can be trimmed to remove any excess material.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A method of using a leak resistant swimwear comprising:

providing a leak resistant swimwear, the leak resistant swimwear being defined by:

a unitary body being manufactured from an elastomeric material, the unitary body including (i) a first leg including a plurality of parallel concentric markers located proximate a lower portion of the first leg, the first leg being tapered; (ii) a second leg including a plurality of parallel concentric markers located proximate a lower portion of the second leg, the second leg being tapered; and (iii) a waist including a plurality of parallel concentric markers located proximate an upper portion of the waist, the waist being tapered sizing the leak resistant swimwear to a wearer; and placing the leak resistant swimwear on the wearer forming a substantially leakproof seal around the legs and waist of the wearer.

2. The method of claim 1, the step of sizing the leak resistant swimwear including:

determining a circumference of at least one thigh of the wearer;

matching the circumference of the at least one thigh to a circumferential line on the first leg or the second leg; and removing any excess material past the matched circumferential line on each leg.

3. The method of claim 2, the step of sizing the leak resistant swimwear further including:

determining a circumference of a waist of the wearer;

matching the circumference of the waist of the wearer to a circumferential line on the waist of the leak resistant swimwear; and removing any excess material above the matched circumferential line on the waist of the leak resistant swimwear.

4. The method of claim 1, wherein the wearer is wearing a diaper when the leak resistant swimwear is placed on the wearer.

5. The method of claim 4, further comprising:

wearing the leak resistant swimwear into a body of water; and at least partially submerging the leak resistant swimwear in the body of water;

wherein the substantially leakproof seal does not allow water to interface with the diaper.

6. A method of implementing a leak resistant swimwear adapted to be worn by a user wearing a diaper, the method comprising:

providing a leak resistant swimwear, the leak resistant swimwear being defined by a unitary piece of elastomeric material having a pair of tapered legs and a tapered waist;

wherein the pair of tapered legs and the tapered waist each include an opening;

placing the leak resistant swimwear on a user wearing a diaper, the diaper being enclosed in the leak resistant swimwear; and entering a body of water while wearing the leak resistant swimwear.

7. The method of claim 6, the leak resistant swimwear including (i) a plurality of parallel concentric markers located proximate a lower portion of each leg, and (ii) a plurality of parallel concentric markers located proximate an upper portion of the waist.

8. The method of claim 7, further including the step of sizing the leak resistant swimwear to the user, the step of sizing the leak resistant swimwear including:

determining a circumference of at least one thigh of the wearer;

matching the circumference of the at least one thigh to a circumferential line on one of the pair of tapered legs;

removing any excess material past the matched circumferential line on each tapered leg;

determining a circumference of a waist of the wearer;

matching the circumference of the waist of the wearer to a circumferential line on the tapered waist of the leak resistant swimwear; and removing any excess material above the matched circumferential line on the tapered waist of the leak resistant swimwear.

9. The method of claim 6, wherein a leakproof seal is formed between the user and the leak resistant swimwear when the leak resistant swimwear is placed on the user.

10. The method of claim 6, wherein the tapered waist is thicker than the rest of the leak resistant swimwear.

11. The method of claim 10, wherein the tapered legs are as thick as the tapered waist.

* * * * *